US010294749B2

(12) United States Patent
Rochen

(10) Patent No.: US 10,294,749 B2
(45) Date of Patent: May 21, 2019

(54) DOWNHOLE PACKER ELEMENT WITH PROPPED ELEMENT SPACER

(71) Applicant: Weatherford Technology Holdings, LLC, Houston, TX (US)

(72) Inventor: James A. Rochen, Waller, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 119 days.

(21) Appl. No.: 15/276,974

(22) Filed: Sep. 27, 2016

(65) Prior Publication Data

US 2018/0087346 A1 Mar. 29, 2018

(51) Int. Cl.

| | |
|---|---|
| ***E21B 33/12*** | (2006.01) |
| ***E21B 43/10*** | (2006.01) |
| ***E21B 43/26*** | (2006.01) |
| ***E21B 33/134*** | (2006.01) |
| ***E21B 33/128*** | (2006.01) |
| *E21B 43/14* | (2006.01) |

(52) U.S. Cl.

CPC ..... *E21B 33/1216* (2013.01); *E21B 33/128* (2013.01); *E21B 33/134* (2013.01); *E21B 43/103* (2013.01); *E21B 43/261* (2013.01); *E21B 43/14* (2013.01)

(58) Field of Classification Search

CPC ..... E21B 33/1216

See application file for complete search history.

(56) References Cited

U.S. PATENT DOCUMENTS

| | | | | |
|---|---|---|---|---|
| 3,799,260 | A * | 3/1974 | Barrington | E21B 33/12 166/185 |
| 4,349,205 | A * | 9/1982 | McGee | E21B 33/04 277/322 |
| 4,765,404 | A | 8/1988 | Bailey et al. | |
| 7,387,158 | B2 | 6/2008 | Murray et al. | |
| 7,552,769 | B2 * | 6/2009 | Cherewyk | E21B 33/068 166/202 |
| 7,708,080 | B2 | 5/2010 | Conaway et al. | |

(Continued)

OTHER PUBLICATIONS

Int'l Search Report and Written Opinion in counterpart PCT Appl. PCT/US2017/052845, dated Dec. 11, 2017, 9-pgs.

(Continued)

*Primary Examiner* — Shane Bomar

(74) *Attorney, Agent, or Firm* — Blank Rome LLP

(57) ABSTRACT

A device and method control the radial expansion of a compressible sealing element on a downhole tool. The tool is deployed adjacent a surrounding surface downhole. The tool has a sealing element with inner and outer members separated by spacers. Inside ends of the outer members overlap extension or lips on the spacers, and fold back rings toward the outer ends of the outer members at least partially limit expansion. To radially expand the sealing element on the downhole tool to seal against the surrounding surface, longitudinally compressions is applied against the sealing element. The fold back rings are expanded initially in this process by using the extensions of the spacers overlapped by the outer members of the sealing element. This allows the fold back rings to square/pack off fully against the surrounding surface during setting and can prevent extrusion of the sealing element over the ends of the fold back rings.

19 Claims, 4 Drawing Sheets

(56) References Cited

U.S. PATENT DOCUMENTS

| | | | |
|---|---|---|---|
| 8,403,036 | B2 | 3/2013 | Neer et al. |
| 8,567,492 | B2 | 10/2013 | White |
| 2009/0255690 | A1 | 10/2009 | Conner et al. |
| 2014/0262351 | A1 | 9/2014 | Derby |
| 2015/0060088 | A1 | 3/2015 | Goodman et al. |
| 2016/0097253 | A1 | 4/2016 | Ruffo et al. |

OTHER PUBLICATIONS

Weatherford, "OptiPkr(TM) Production Packer," Product Brochure, copyright 2010-2015, 2-pgs.

* cited by examiner

DOWNHOLE PACKER ELEMENT WITH PROPPED ELEMENT SPACER

BACKGROUND

In connection with the completion of oil and gas wells, it is frequently necessary to utilize packers in both open and cased boreholes. The walls of the well or casing are plugged or packed from time to time for a number of reasons. As shown in FIG. 1, for example, sections of a well 10 may be packed off with packers 16 on a tubing string 12 in the well. The packers 16 isolate sections of the well 10 so pressure can be applied to a particular section of the well 10, such as when fracturing a hydrocarbon bearing formation, through a sliding sleeve 14 while protecting the remainder of the well 10 from the applied pressure.

FIGS. 2A-2B depict portions of a downhole tool 16 in partial cross-section having a packer element 50 according to the prior art. The packer element 50 is disposed adjacent the housing 20 of the tool 16 between end rings 22, 24 and includes an inner elastomeric member 52 separated by spacers 56 from outer elastomeric members 54.

The packer element 50 may be suited for High Pressure/High Temperature applications. As such, the packer element 50 typically includes metal fold back rings 58 to contain the elastomeric elements 52, 54 from extruding and leaking due to pressures causing high extrusion forces on the elements 52, 54. The metal fold back rings 58 require a thick cross-section to contain and prevent elastomer extrusion. As shown in FIG. 2B, the thick cross-section can create scenarios where the elastomer can extrude over the top of the metal fold back rings 58 during setting of the packer element 50. This over-extrusion can lead to failure of the packer element 50.

In addition to over-extrusion, the conventional HP/HT metal fold back rings 58 typically do not completely square-off or fully pack-off during initial setting. Therefore, the metal fold back rings 58 may tend to move and square-off additional amounts after setting when the element 50 is later subjected to pressure differentials. This is typically acceptable with boosted packers, but non-boosted packers tend to leak when these additional movements occur especially during thermal cycling.

In one possible solution to the problem, the tips of the metal fold back rings 58 can be machined very thin to allow for easier expansion during setting. Although this modification can help with the rings' expansion during setting, the machining steps can be costly and can make the rings very fragile and easy to damage during handling. In another less desirable solution, the maximum temperature rating for the packer element 50 can simply be reduced, but this limits possible uses and implementations.

Therefore, a need exists for a packer for use in high pressure and high temperature applications having fold back rings capable of square-off or full pack-off during setting.

The subject matter of the present disclosure is directed to overcoming, or at least reducing the effects of, one or more of the problems set forth above.

SUMMARY

An apparatus is used downhole adjacent a surrounding surface. The apparatus includes a first element, a spacer, a second element, and a ring. The first element is disposed on the apparatus and is compressible longitudinally to expand radially outward and seal against the surrounding surface. The spacer is disposed on the apparatus adjacent the first element. The spacer has an extension that extends from the spacer and along the apparatus away from the first element.

The second element is disposed on the apparatus and is separated at least partially from the first element by the spacer. This second element has a first end at least partially overlapping the extension of the spacer. Like the first element, the second element is compressible longitudinally to expand radially outward and seal against the surrounding surface. Finally, the ring is disposed on the apparatus. The ring at least partially overlaps a second end of the second element and at least partially limits the radial expansion of the second element.

The first member can be a first sleeve composed of an elastomeric material and disposed circumferentially about the apparatus. Likewise, the second member can be a second sleeve composed of an elastomeric material and disposed circumferentially about the apparatus. The apparatus can be symmetrically arranged with second members and spacers disposed on both opposing sides of the first member. In fact, the apparatus can include a packer, a liner hanger, a plug, a bridge plug, or a fracture plug.

The spacer can include a ring body extending radially from the apparatus that separates the first and second elements from one other. The extension can include a cylindrical lip extending longitudinally from the ring body adjacent the apparatus. This cylindrical lip can have a slanted outer surface against which the first end of the second element overlaps. The extension can have a nodule protruding outwardly therefrom over which the first end of the second element overlaps. Finally, the spacer can be composed of metal, plastic, elastomer, or the like.

For its part, the ring can be a fold back ring preferably composed of metal, but other materials, such as plastic or elastomer, can be used. To enhance the timing of expansion for the fold back ring, the first end of the second element overlapping the extension can define a gap longitudinally from a portion of the spacer adjacent the first element. In this way, longitudinal pushing of the extension tends to compress and expand the second element before the ring body of the spacer tends to compress and expand the element's overlapping end.

The apparatus can have a mandrel on which the first element, the spacer, the second element, and the ring are disposed. A push member disposed on the mandrel can be movable on the mandrel against the first element, the spacer, the second element, and the ring to compress them during setting.

According to the present disclosure, a method is disclosed for sealing a downhole tool against a surrounding surface. The downhole tool has a sealing element and deploys adjacent the surrounding surface downhole. The sealing element has an inner sealing member, spacers disposed outside the inner sealing member, outer sealing members disposed outside the spacers, and fold back rings disposed outside the outer sealing members. The method involves longitudinally compressing against the sealing element. The fold back rings initially expand in response to the longitudinal compression by using extensions of the spacers overlapped by ends of the outer sealing members. Ultimately, the inner and outer sealing members radially expand on the downhole tool in response to the longitudinal compression to seal against the surrounding surface.

To radially expand the inner and outer sealing members, an inner sleeve for the inner sealing member composed of an elastomeric material and disposed circumferentially about the downhole tool can be radially expanded. The outer sealing members can likewise be second sleeves composed of an elastomeric material and disposed circumferentially about the downhole.

In the radial expansion of the inner and outer sealing members, ring bodies of the spacers extending radially from the downhole tool can be pushed against opposing sides of the inner sealing member. Meanwhile, cylindrical lips of the extensions extending longitudinally from the ring bodies adjacent the downhole tool can push against portions of the outer sealing members. Compression of the first ends of the outer sealing members overlapping the extension can be delayed, however, using gaps defined longitudinally between portions of the spacers and the first ends.

As used herein, the terms such as lower, downhole, downward, upper, uphole, and upward are merely provided for understanding. Additionally, the terms packer and plug may be used interchangeably.

The subject matter of the present disclosure is directed to overcoming, or at least reducing the effects of, one or more of the problems set forth above.

DETAILED DESCRIPTION

The description that follows includes exemplary apparatus, methods, techniques, and instruction sequences that embody techniques of the inventive subject matter. However, it is understood that the described embodiments may be practiced without these specific details.

Figure 1:
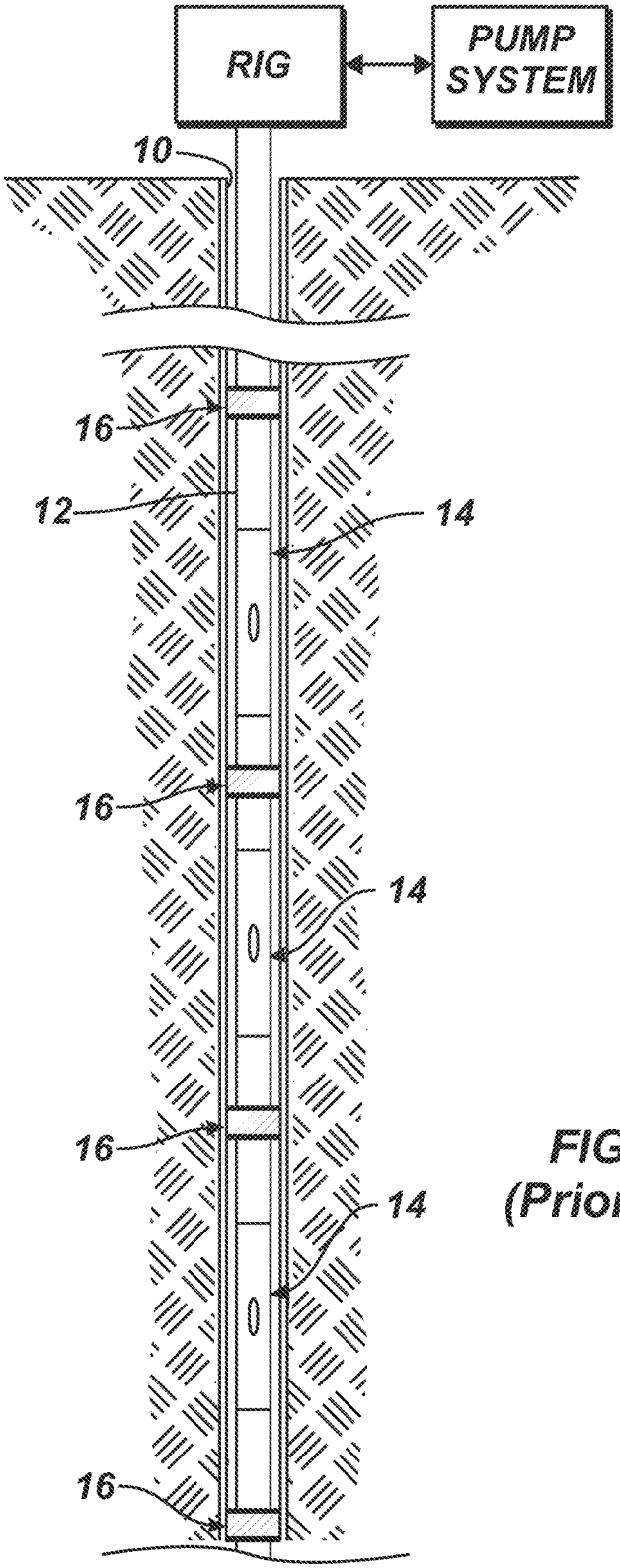
FIG. 1 (Prior Art)
FIG. 1 depicts a wellbore having a tubular with a plurality of sealing element tools disposed thereon.
Figure 2A:
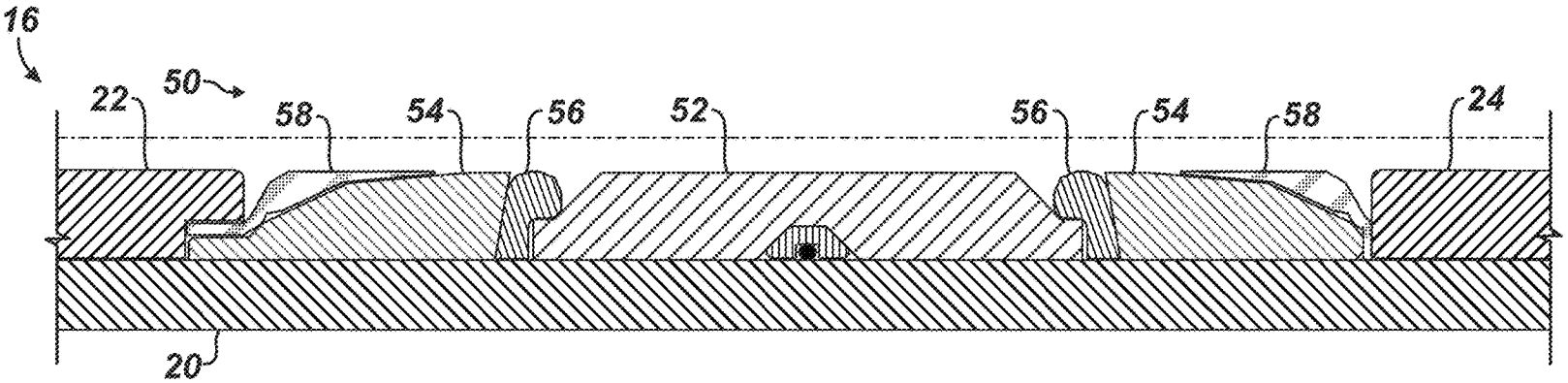
FIG. 2A (Prior Art)
FIGS. 2A-2B depict portions of a downhole tool in partial cross-section having a sealing element according to the prior art.
Figure 2B:
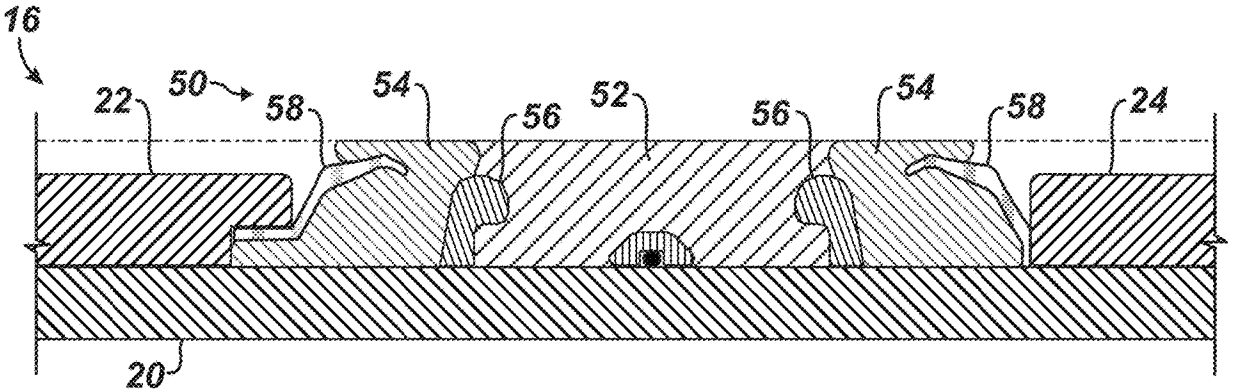
FIG. 2B (Prior Art)
Figure 3A:
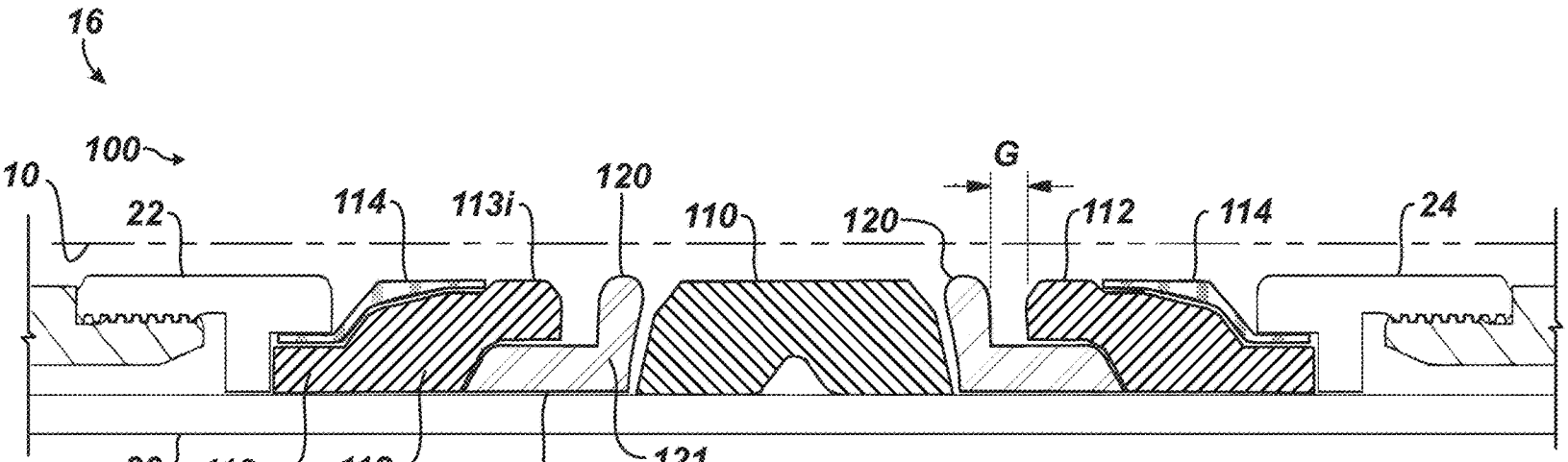
FIGS. 3A-3B depict portions of a downhole tool in partial cross-section having a sealing element according to the present disclosure.
Figure 3B:
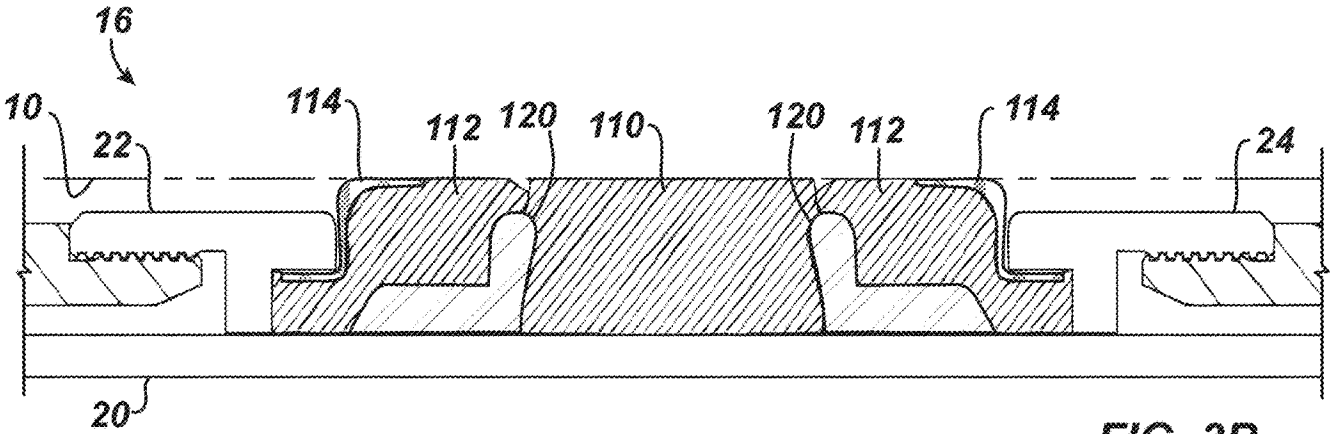

FIGS. 3A-3B depict portions of a downhole tool 16 in partial cross-section having a compressible packer element 100 according to the present disclosure. As depicted here, the tool 16 can have a housing 20 with a through-bore and can seal against a surrounding surface, such as casing or downhole tubular 10. End rings 22, 24 are disposed on the housing 20 at opposing ends of the sealing element 100. One end ring 24 can be fixed, while the other end ring 22 can be a push ring moved by a setting mechanism (not shown). Other arrangements can be used. As will be appreciated, the tool 16 can include a slip assembly (not shown) to engages the casing 10, can include a body lock ring (not shown) to lock the end ring 22 longitudinally in place, and can include other common features.

The sealing element 100 has an inner compressible member 110 separated by at least one spacer 120 from at least one outer compressible members 112. As depicted in FIG. 3A, the sealing element 100 may be symmetrically arranged with the inner member 110 separated by spacers 120 from opposing outer members 112.

The inner member 110 disposed on the housing 20 is compressible longitudinally to expand radially outward and seal against the surrounding surface 10. For example, the inner member 110 can be a cylindrical sleeve of compressible elastomeric material disposed circumferentially about the housing 20.

The spacers 120 can be ring-shaped members disposed outside the tool's housing 20 and can be composed of metal, plastic, hard elastomer, or the like. The spacers 120 have extensions 122 extending from the spacers 120 and along the housing 20 away from the inner member 110. In particular, each spacer 120 includes a ring body 121 extending radially from the housing 20 and disposed adjacent the opposing ends of the inner member 110. The ring body 121 separates the inner member 110 from the outer members 112. The extensions 122 of the spacers 120 include cylindrical lips extending longitudinally from the ring bodies 121 adjacent the housing 20.

The outer members 112 are disposed on the housing 20 adjacent the spacers 120. The outer members 112 have inside ends or edges 113*i* overlapping the extensions 122 of the spacers 120. Like the inner members 110, the outer members 112 are compressible longitudinally to expand radially outward and seal against the surrounding surface 10. As such, the outer members 112 can be cylindrical sleeves of comparable material used for the inner member 110.

Fold back rings 114 fit outside the outer members 112. Preferably, the fold back rings 114 are composed of metal, but other materials, such as plastic or elastomer, can be used. Portions of the fold back rings 114 overlap over outer ends or edges 113*o* of the outer members 110. The fold back rings 114 can be cup-shaped, can have solid surface, can have petals or divisions, and/or can include several rings stacked together.

As shown, ends of the rings 114 may be partially retained by the end rings 22, 24, although other configurations can be used. The fold back rings 114 at least partially limit the radial expansion of these outer members 112 and at least partially limit their extrusion toward the end rings 22, 24.

The disclosed packer element 100 can be used on any type of downhole tool 16 used for sealing in a borehole, including, but not limited to, a packer, a through-tubing packer, a service packer, a liner hanger, a bridge plug, a fracture plug, and the like.

The packer element 100 has an initial diameter to allow the tool 16 to be run into a well and has a second, radially-larger size when compressed to seal against the surface of the casing 10 or the like. When the tool 16 is deployed downhole to the desired setting location, the housing 20 can be held in place, and force can be applied longitudinally to the push ring 22 by the setting mechanism (not shown), which can be a hydraulic piston mechanism or the like.

For example, the push ring 22 can be activated by a build-up of hydraulic pressure in a chamber of the mechanism. In turn, the mechanism can push the push ring 22 against the end of the packer element 100 to compress the packer element 100 longitudinally against the fixed ring 24. As it is compressed, the packer element 100 expands radially outward to engage the surrounding surface 10 of the open or cased hole. Although the tool 16 can be hydraulically actuated, other types of mechanisms known in the art can be used on the tool 16 including, mechanical, hydro-mechanical, and electrical mechanisms for compressing the packer element 100.

As noted above, the element spacers 120 have extended lips 122 along the tool's mandrel 20 that fit under the inside ends 113*i* of the outer compressible elements 112. In this way, the extended lips 122 of the spacers 120 initially prop up these inside ends 113*i*. During setting, the extended lips 122 first push against the outer ends 113*o* of the elements 112, which causes the outer ends 113*o* to first expand the metal fold back rings 114 before the outer elements 112 can contact the surface 10 and extrude over the fold back rings 114. Consequently, the compression/expansion of the outer members 112 at the outside ends 113*o* first deforms the fold back rings 114 toward the surface 10, thereby reducing chances for the elastomer to extrude over the rings 114 and get caught in between the rings 114 and the surface 10.

As shown, the inside ends 113*i* of the outer members 112 overlapping the lips 122 can define gaps G longitudinally from the ring bodies 121 of the spacers 120. The defined gap G allows the outside ends 113*o* of the outer elements 112 to be pushed first by the extended lips 122 and to expand the metal fold back rings 114 before the spacer's ring body 121 can push against the inside ends 113*i*. In one implementation, the gap G can be approximately 0.1 to 0.5-in. for a standard size packer, although other values could be used. When the gap G is then reduced during setting, the body 121 of the spacers 120 can then push against the inside ends 113*i* of the outer members 112 as the inner and outer members 110, 112 are sandwiched.

The disclosed packer element 100 may allow for setting at higher temperatures while lowering the risk of over-extrusion of the elastomer material around the metal fold back rings 114 during setting. Additionally, the disclosed packer element 100 can allow for lower setting forces to be used.

Finally, as noted previously, conventional HP/HT metal fold back rings typically do not completely square-off or fully pack-off during initial setting. Therefore, the metal fold back rings may move/square-off additional amounts during pressure differentials. As depicted in FIG. 3B, however, the disclosed packer element 100 with the extended lips 122 on the spacers 120 can better squared-off or pack off the metal fold back rings 114 during setting so that the packer element 100 may offer better sealing characteristics.

Figure 4A:
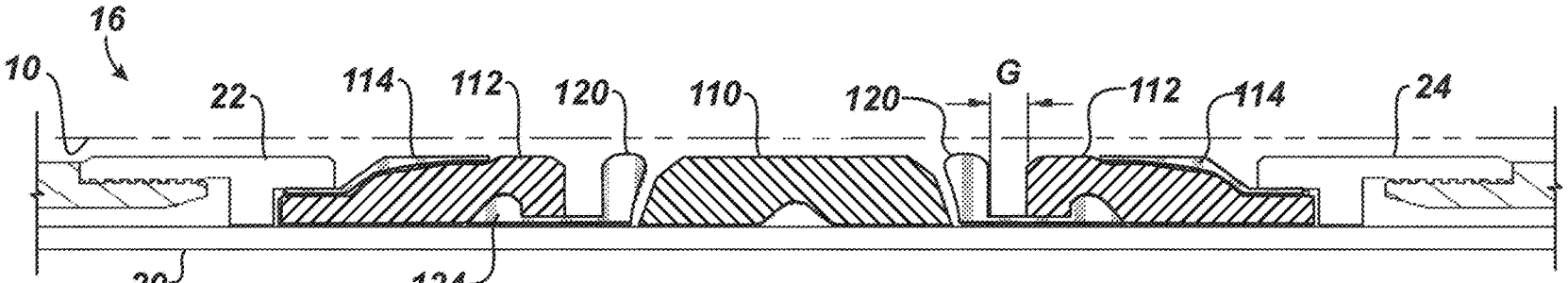
FIGS. 4A-4C depict portions of downhole tools in partial cross-section having additional sealing elements according to the present disclosure.
Figure 4B:
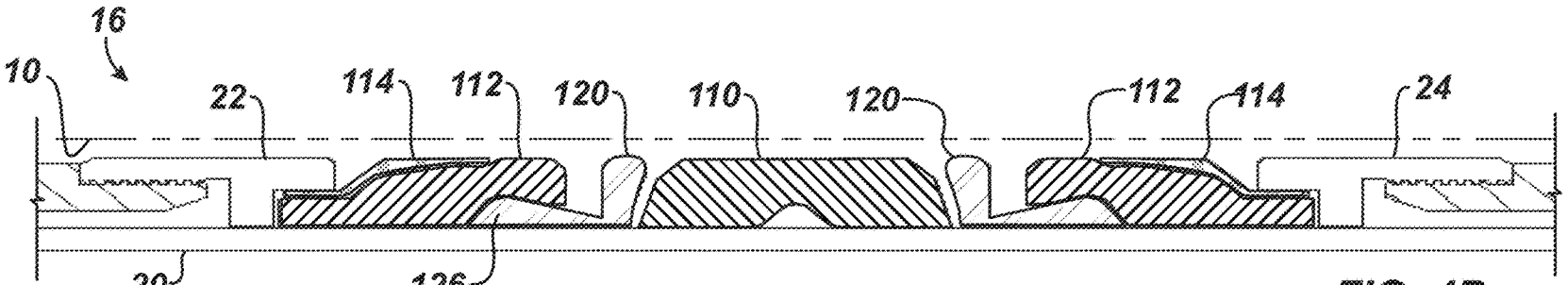
Figure 4C:
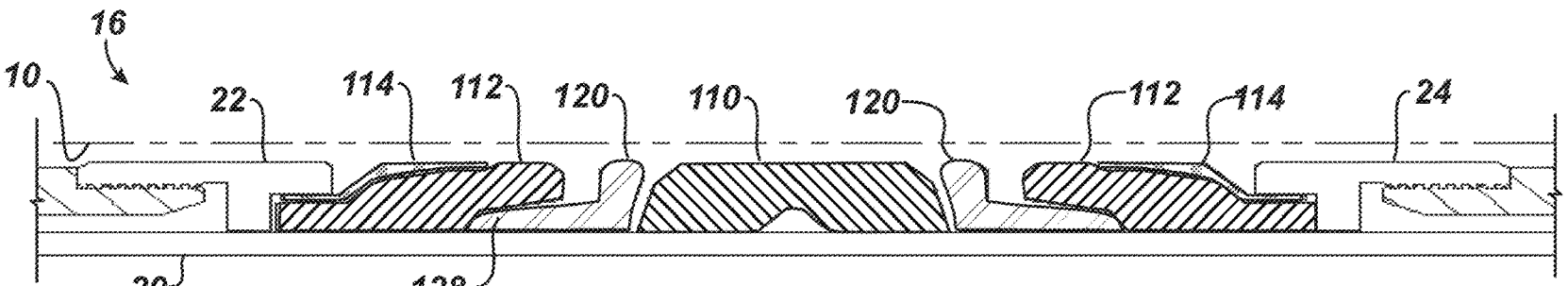

FIGS. 4A-4C depict portions of downhole tools 16 in partial cross-section having additional packer elements 100 according to the present disclosure. The spacer elements 120 in FIG. 4A have extended nodules 124 fitting under portions of the outer compressible elements 112. The spacer elements 120 in FIG. 4B have inward slanting lips 126, while the spacer elements 120 in FIG. 4C have outward slanting lips 128. As these shapes will show, various extension shapes can be used for the spacer elements 120 of the disclosed packer elements 100 to prop up inside ends 113*i* of the outer compressible elements 112, initially expand the metal fold back rings 114, and achieve the additional purposes disclosed herein.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. An apparatus used downhole adjacent a surrounding surface, the apparatus comprising:

a first element disposed on the apparatus and being compressible longitudinally to expand radially outward and seal against the surrounding surface;

a spacer disposed on the apparatus adjacent the first element, the spacer comprising a ring body and a cylindrical lip, the ring body extending radially outward from the apparatus against the first element, the cylindrical lip extending longitudinally adjacent the apparatus from the ring body to a distal end away from the first element, the cylindrical lip increasing in thickness from the ring body to the distal end;

a second element disposed on the apparatus and separated at least partially from the first element by the ring body of the spacer, the second element having a first end at least partially overlapping against the cylindrical lip of the spacer and covering the distal end, the second element being compressible longitudinally to expand radially outward and seal against the surrounding surface; and a ring disposed on the apparatus, the ring at least partially overlapping a second end of the second element and at least partially limiting the radial expansion of the second element.

2. The apparatus of claim 1, wherein the first element comprises a first sleeve composed of an elastomeric material and disposed circumferentially about the apparatus.

3. The apparatus of claim 2, wherein the second element comprises a second sleeve composed of an elastomeric material and disposed circumferentially about the apparatus.

4. The apparatus of claim 1, wherein the second element, the spacer, and the ring are disposed on one side of the first element, and wherein the apparatus further comprises another second element, another spacer, and another ring disposed on an opposing side of the first element.

5. The apparatus of claim 1, wherein the spacer comprises a material selected from the group consisting of metal, plastic, and elastomer.

6. The apparatus of claim 1, wherein the ring comprises a material selected from the group consisting of metal, plastic, and elastomer.

7. The apparatus claim 1, wherein the first end of the second element overlapping the extension defines a gap longitudinally from a portion of the spacer adjacent the first element.

8. The apparatus of claim 1, further comprising:

a mandrel of the apparatus on which the first element, the spacer, the second element, and the ring are disposed; and a push member disposed on the mandrel and being movable on the mandrel against the ring, the second element, the spacer, and the first element.

9. The apparatus of claim 1, wherein the apparatus is selected from the group consisting of a packer, a liner hanger, a plug, a bridge plug, and a fracture plug.

10. An apparatus used downhole adjacent a surrounding surface, the apparatus comprising:

a first element disposed on the apparatus and being compressible longitudinally to expand radially outward and seal against the surrounding surface;

a spacer disposed on the apparatus adjacent the first element, the spacer comprising a ring body and a cylindrical lip, the ring body extending radially outward from the apparatus against the first element, the cylindrical lip extending longitudinally adjacent the apparatus from the ring body to a distal end away from the first element, the distal end having a nodule protruding radially outwardly from a circumference of the cylindrical lip;

a second element disposed on the apparatus and separated at least partially from the first element by the ring body of the spacer, the second element having a first end at least partially overlapping against the cylindrical lip of the spacer and covering the nodule protruding outwardly therefrom, the second element being compressible longitudinally to expand radially outward and seal against the surrounding surface; and a ring disposed on the apparatus, the ring at least partially overlapping a second end of the second element and at least partially limiting the radial expansion of the second element.

11. The apparatus of claim 10, wherein the first element comprises a first sleeve composed of an elastomeric material and disposed circumferentially about the apparatus.

12. The apparatus of claim 11, wherein the second element comprises a second sleeve composed of an elastomeric material and disposed circumferentially about the apparatus.

13. The apparatus of claim 10, wherein the second element, the spacer, and the ring are disposed on one side of the first element, and wherein the apparatus further comprises another second element, another spacer, and another ring disposed on an opposing side of the first element.

14. The apparatus of claim 10, wherein the cylindrical lip comprises a slanted outer surface against which the first end of the second element overlaps.

15. The apparatus of claim 10, wherein the spacer comprises a material selected from the group consisting of metal, plastic, and elastomer.

16. The apparatus of claim 10, wherein the ring comprises a material selected from the group consisting of metal, plastic, and elastomer.

17. The apparatus of claim 10, wherein the first end of the second element overlapping the extension defines a gap longitudinally from a portion of the spacer adjacent the first element.

18. The apparatus of claim 10, further comprising:

a mandrel of the apparatus on which the first element, the spacer, the second element, and the ring are disposed; and a push member disposed on the mandrel and being movable on the mandrel against the ring, the second element, the spacer, and the first element.

19. The apparatus of claim 10, wherein the apparatus is selected from the group consisting of a packer, a liner hanger, a plug, a bridge plug, and a fracture plug.

* * * * *